US005126711A

United States Patent [19]

Sasakawa et al.

[11] Patent Number: 5,126,711

[45] Date of Patent: Jun. 30, 1992

[54] SUPERCONDUCTIVE COIL SYSTEM

[75] Inventors: Ryoichi Sasakawa, Tokyo; Yoichi Iwamoto, Takasago; Yasuo Kannoto, Takasago; Hisashi Sekimoto, Takasago; Chiaki Matsuyama, Kobe; Kazuyoshi Hayakawa, Kobe; Hiroaki Morita, Kobe; Masahide Arayasu, Kobe, all of Japan

[73] Assignees: Ship & Ocean Foundation; Mitsubishi Jukogyo Kabushiki Kaisha, both of Tokyo, Japan

[21] Appl. No.: 675,972

[22] Filed: Mar. 28, 1991

[51] Int. Cl.[5] ..... H01R 4/00; H01F 1/00; H01F 7/22

[52] U.S. Cl. ..... 335/216; 335/213; 335/296; 335/299; 335/210; 174/92; 505/705; 505/879; 505/1; 336/90; 336/DIG. 1

[58] Field of Search ..... 335/210, 213, 216, 296, 335/299; 336/90, 92, 100, DIG. 1; 174/92; 505/705, 879, 1

[56] References Cited

U.S. PATENT DOCUMENTS 3,838,213 9/1974 Georgopulos et al. ..... 174/92
3,846,725 11/1974 Mears, Jr. ..... 336/92
4,979,704 12/1990 Lowry et al. ..... 335/216

FOREIGN PATENT DOCUMENTS 1-94603 4/1989 Japan .
984179 2/1965 United Kingdom .

*Primary Examiner*—Leo P. Picard
*Assistant Examiner*—Ramon M. Barrera
*Attorney, Agent, or Firm*—Wenderoth, Lind & Ponack

[57] ABSTRACT

A novel construction of a superconductive coil system, having sufficient coupling strength and stiffness and being easy to assemble, is disclosed. A coil retainer of a stiffened cylindrical shell is divided into two parts for receiving coils and spacers. The inner circumference sides of the adjoining portions of the two parts form a dividing surface consisting of a plane extending longitudinally and are coupled with bolts having their axes directed in the circumferential direction. The outer circumference sides of the same adjoining portions form comb teeth meshed with each other and keyways extending longitudinally along the outer surface of the same comb teeth, and are coupled by keys inserted into the keyways and having their axes directed in the longitudinal direction. Preferably, left and right coils having profiles of the shape of divided pieces obtained by longitudinally dividing a cylinder, and upper and lower spaces sandwiched between the coils and having profiles of the shape of the remaining divided pieces, are disposed within the coil retainer, with outer circumference of the coils and spacers kept constrained.

2 Claims, 4 Drawing Sheets

SUPERCONDUCTIVE COIL SYSTEM

BACKGROUND OF THE INVENTION

1. Field of the Invention

The present invention relates to a superconductive coil system that is applicable to a product requiring a strong magnetic field.

2. Description of the Prior Art

In general, a superconductive coil system generates an intense electromagnetic force when it is energized, and hence in order to prevent deformation caused thereby, a strong restraining device is necessitated. Therefore, a superconductive coil system in the prior art was constructed as shown in FIGS. 4 to 6. More particularly, a superconductive coil 1 was constrained jointly with spacers 4 by surrounding the outer circumference of the coil with a coil retainer 2 of a stiffened cylindrical shell divided into upper and lower parts, and under the condition where comb teeth 5 of the upper and lower coil retainer parts had been meshed with each other, coupling pins 3 were inserted over the entire length of the coil retainer 2 to integrate the coil retainer parts.

However, the above-described superconductive coil system in the prior art involved the following problems to be resolved:

(1) The pins 3 for coupling the divided two parts of the coil retainer 2 are necessitated to be inserted over the entire length of the coil retainer 2. Therefore, if the size in the axial direction of the coil should become large, the coupling pins 3 would become extremely long and slender, hence workability at the time of inserting the pins 3 would become poor, and problems of seizure and the like would liable to occur.

(2) In order to insert the pins, fitting clearances between the pins 3 and the corresponding pin insert holes are necessary, but if the clearances are made large for the purpose of facilitating assembling, rattle is produced after assembly, an amount of deformation becomes large, and in some cases there is a risk of causing instability of the coil.

(3) Due to the electromagnetic force generated by the superconductive coil 1, upon the coupling portions of the coil retainer 2 is exerted a torque which appears as a tensile force on the side of the outer circumference, and two coupling pins 3 on the respective sides would bear the torque, but since the coupling pins 3 are positioned between the inner surface and the outer surface of the coil retainer 3, the moment arm of the torque is short, hence a load applied to the coupling pin 3 would become large, and the size of the product would become large.

SUMMARY OF THE INVENTION

It is therefore one object of the present invention to provide a novel superconductive coil system, which has sufficient coupling strength and stiffness (non-rattle) and which is easy to assemble.

According to one feature of the present invention, there is provided a superconductive coil system, wherein the inner circumference sides of adjoining portions of two parts of a coil retainer of a stiffened cylindrical shell shape divided into two parts for receiving coils and spacers form a dividing surface consisting of a plane extending longitudinally and are coupled with bolts having their axes directed in the circumferential direction, and the outer circumference sides of the same adjoining portions form comb teeth meshed with each other and keyways extending longitudinally along the outer surface of the same comb teeth and are coupled by means of keys inserted in the same keyways and having their axes directed in the longitudinal direction.

According to another feature of the present invention, there is provided the above-featured superconductive magnet system, wherein into two parts, and within the same coil retainer are disposed left and right coils having profiles of the shape of divided pieces obtained by longitudinally dividing a cylinder, and upper and lower spacers sandwiched between the same coils and having profiles of the remaining divided pieces, with outer circumference of the coils and spaces kept constrained.

According to the present invention, owing to the above-mentioned structural features, tensile forces in the circumferential direction acting upon the coil retainer as reaction forces against initial compression upon assembly of the coils, are borne by the bolts. In addition, since a torque acting upon the coil retainer due to electromagnetic forces upon energization of the coils would appear as a compression load on the inner circumference side of the dividing surface of the coil retainer and as a tension force on the outer circumference side of the same, on the inner circumference side the load is borne on the plane (flat surface) of the longitudinally extending member and on the outer circumference side the load is borne by the key in the comb teeth portion. Furthermore, in this case a moment arm of the torque becomes long, and hence stiffness becomes large. In addition, as the coupling is effected by means of bolts and keys, the work is easy and rattle will not arise.

In this way, according to the present invention, a superconductive coil system having sufficient coupling strength and stiffness (non-rattle) which is easy assemble can be provided.

The above-mentioned and other objects, features and advantages of the present invention will become more apparent by referring to the following description of one preferred embodiment of the present invention taken in conjunction with the accompanying drawings.

DETAILED DESCRIPTION OF THE PREFERRED EMBODIMENT

Now one preferred embodiment of the present invention will be described in detail with reference to FIGS. 1 to 3.

It is to be noted that for the purpose of avoiding redundancy, an explanation of the parts already described in connection with the coil system in the prior art will be omitted, and portions relevant to this invention will be principally explained.

Figure 2:
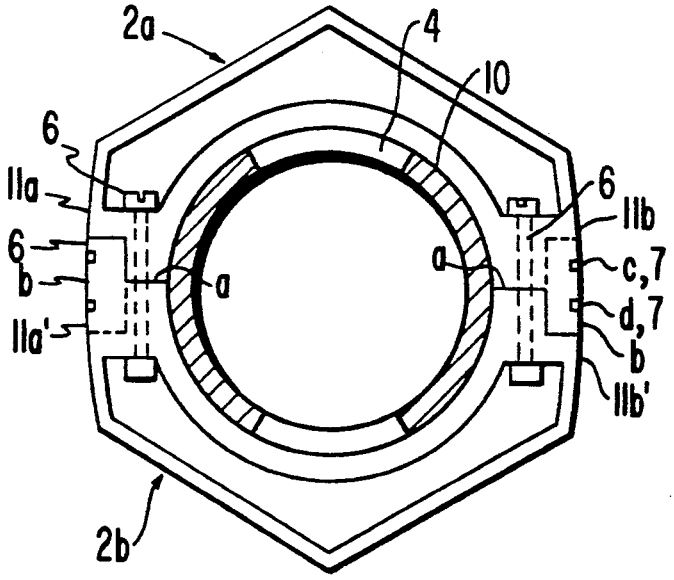
FIG. 2 is a front view of the preferred embodiment shown in FIG. 1.

In FIG. 2, profiles of left and right coils 10 have the shape of pieces produced by longitudinally dividing a cylindrical form. In addition, profiles, of upper and lower spacers 4 have the shape of the remaining divided pieces, and are sandwiched between the coils 10.

Figure 1:
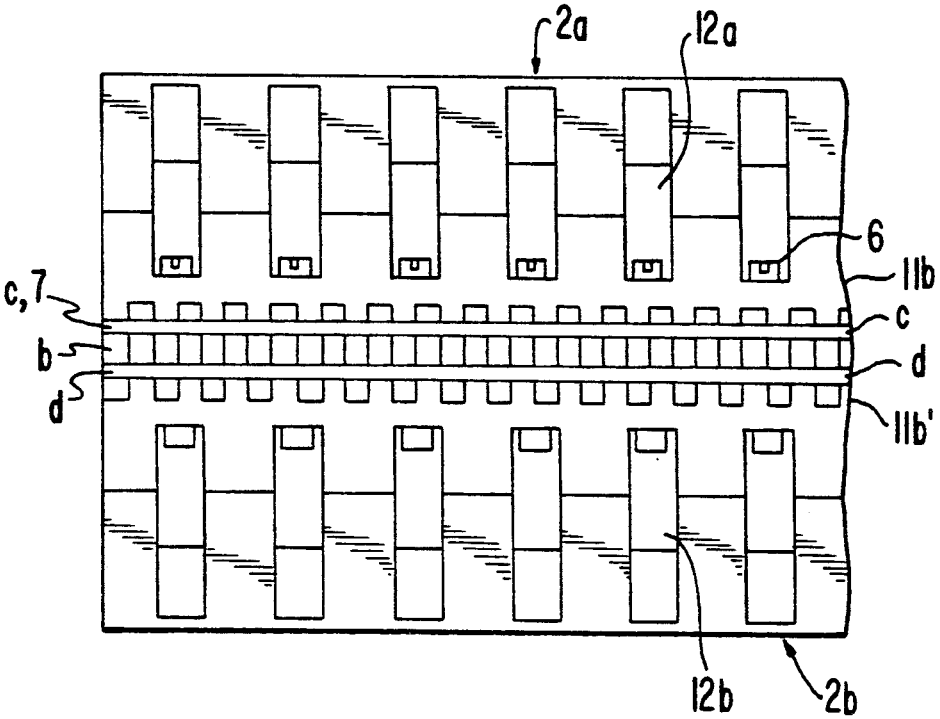
FIG. 1 is a side view of one preferred embodiment of the present invention.
Figure 3:
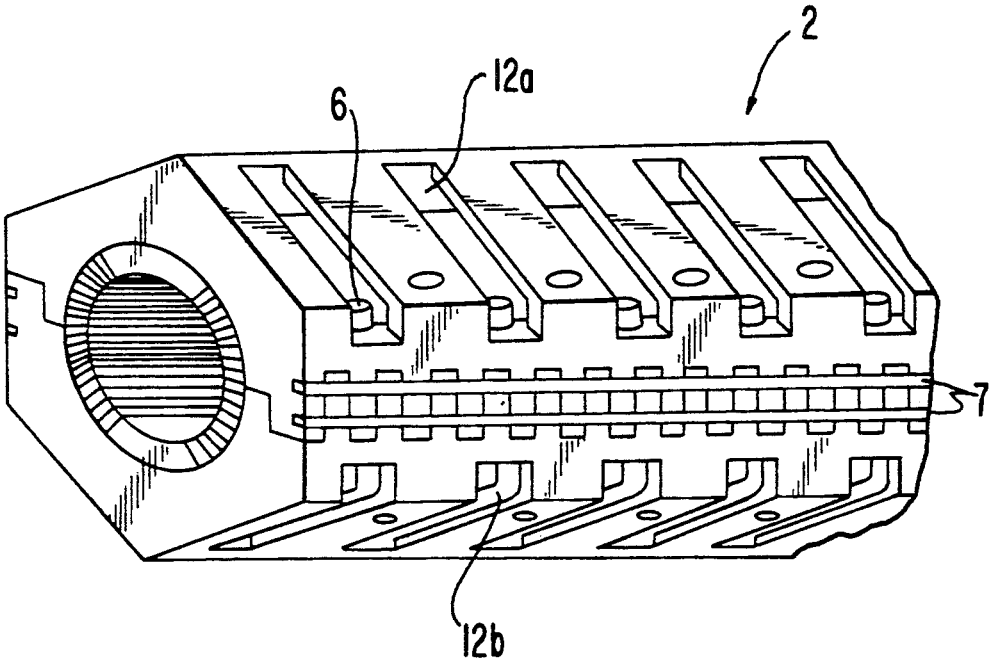
FIG. 3 is a perspective view of the same preferred embodiment.
Figure 4:
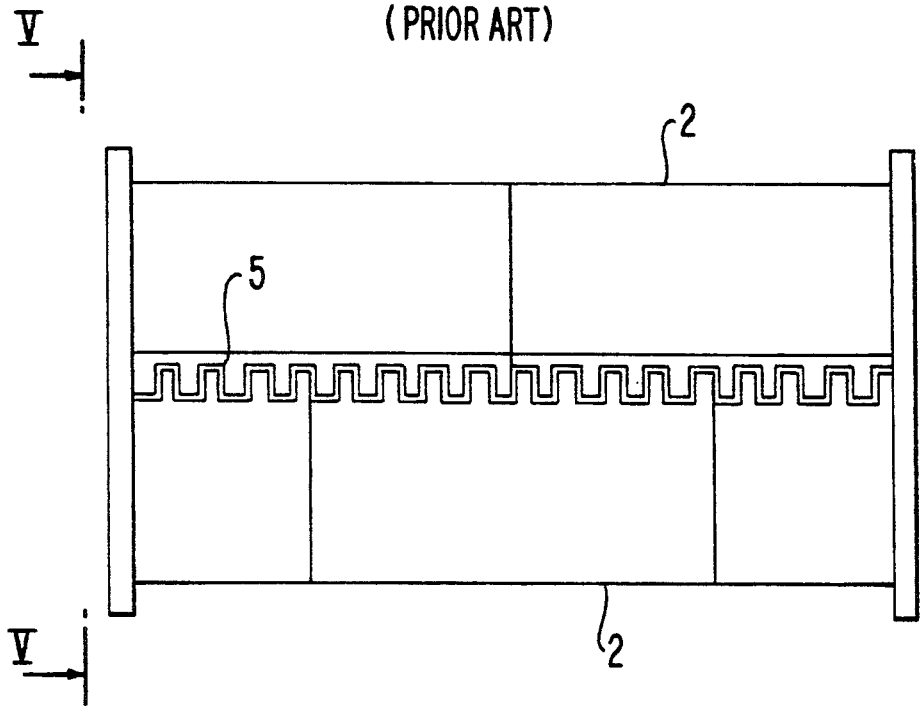
FIG. 4 (PRIOR ART)
FIG. 4 is a side view of one example of a superconductive coil system in the prior art.
Figure 5:
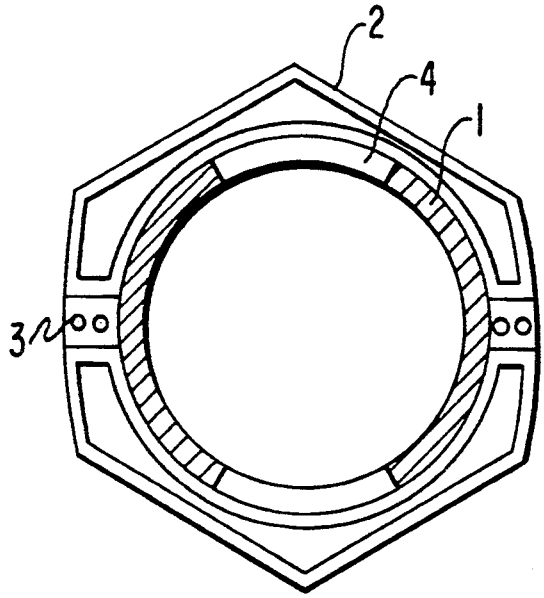
FIG. 5 (PRIOR ART)
FIG. 5 is a front view of the coil system in FIG. 4.
Figure 6:
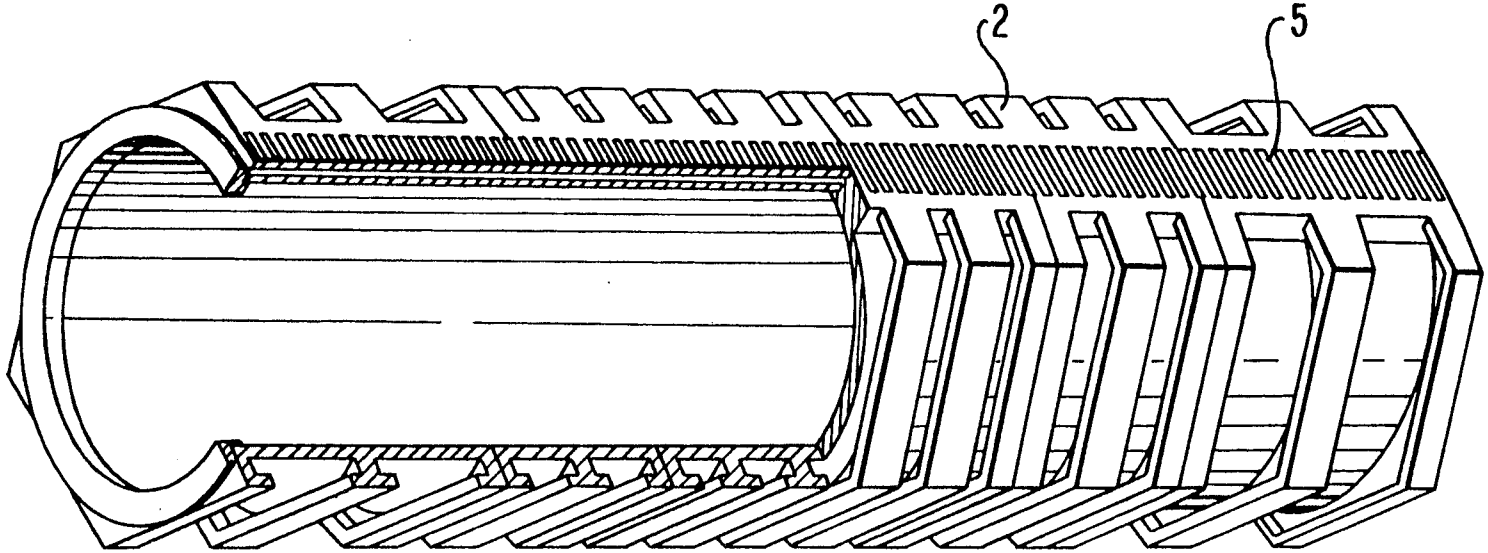
FIG.6 (PRIOR ART)
FIG. 6 is a perspective view of the same coil system.

As shown in FIGS. 1 to 3, upper and lower coil retainers 2*a* and 2*b* have a stiffened cylindrical shape constituted by upper and lower parts, and their inner circumferential surfaces are held in contact with the outer circumferential surfaces of the coils 10 and the spacers 4. A left adjoining portion 11*a* and a right adjoining portion 11*b* of the upper coil retainer 2*a* are respectively opposed to a left adjoining portion 11*a'* and a right adjoining portion 11*b'* of the lower coil retainer 2*b*.

On the inner circumference sides of the respective adjoining portions are provided planes a extending longitudinally. On both the left and right sides (as viewed in FIG. 2) of the above-described upper coil retainer 2*a* are formed a plurality of grooves 12*a* extending from the upper part to the plane a, and similarly on both the left and right sides (as viewed in FIG. 2) of the above-described lower coil retainer 2*b* are formed a plurality of grooves 12*b* extending from the bottom part to the plane a. The planes a of the upper and lower coil retainers 2*a* and 2*b* are positioned within the respective grooves 12*a* and 12*b*, and the upper and lower coil retainers 2*a* and 2*b* are coupled by means of a plurality of bolts 6 having their axes directed in the circumferential direction. In addition, as shown in FIGS. 1 to 3, on the outer circumference sides of the adjoining portions are formed longitudinal arrays of comb teeth b meshed with each other. Furthermore, on the outer surfaces of the same comb teeth b are formed tapered upper keyways c and lower keyways d extending longitudinally, and tapered keys 7 are respectively inserted into these keyways c and d to couple the adjoining portions.

In the above-described construction, the coupling bolts 6 of the coil system would bear the forces in the circumferential direction of the coil retainers generated upon initial compression in the case of assembling the coils 10 and the spacers 4, and the keys would bear the torques generated upon energization of the coils.

In this way, a coil system having an excellent workability and provided with sufficient coupling forces and stiffness can be provided.

It is to be noted that while the keys 7 were described as tapered keys in the above-described embodiment, they could be parallel keys without being specifically limited.

As will be obvious from the detailed description of the invention above, according to the present invention, the following advantages are obtained:

(1) Coupling of the divided parts of the coil retainer is effected by fastening of bolts on the inner circumference side and by inserting keys on the outer circumference side, hence there is no need to strike long and slender pins into the divided parts, and assembling work can be simplified.

(2) Since the bolt coupling and the coupling by keys do not create clearances, rattle would not occur.

(3) The torques caused by electromagnetic forces are borne by the plane contact portions on the inner circumference side and the keys on the outer circumference side, a moment arm of the torque can be chosen long, and so, the proposed construction is advantageous in design.

Since many changes and modifications can be made to the illustrated construction without departing from the spirit of the present invention, it is intended that all matter contained in the above description and illustrated in the accompanying drawings shall be interpreted to be illustrative and not in a limiting sense.

What is claimed is:

1. A superconductive coil system comprising a coil retainer including a stiff cylindrical shell divided into two parts for receiving therebetween coils and spacers, inner circumference sides of adjoining portions of the two parts of said coil retainer into two parts for assembling coils and spacers each defining a dividing surface consisting of a plane extending longitudinally, and outer circumference sides of said adjoining portions forming comb teeth meshed with each other and defining keyways extending longitudinally along the outer surface of said comb teeth; bolts coupling said two parts, said bolts having longitudinal axes extending in the circumferential direction of said shell; and keys inserted into said keyways and having their axes extending in the longitudinal direction so as to also couple said two parts.

2. A superconductive coil system as claimed in claim 1, wherein within said coil retainer are disposed left and right coils and having profiles of the shape of divided pieces obtained by longitudinally dividing a cylinder, and upper and lower spacers sandwiched between said coils and having profiles of the shape of the remaining divided pieces, with the outer circumference of said coils and spacers kept constrained.

* * * * *